United States Patent [19]

Karl et al.

[11] Patent Number: 4,890,450

[45] Date of Patent: Jan. 2, 1990

[54] SPINNING MACHINE WITH A DEVICE TO SERVICE SPINNING AND WINDING STATIONS

[75] Inventors: Rupert Karl; Rudolf Becker, both of Ingolstadt, Fed. Rep. of Germany

[73] Assignee: Schubert & Salzer Maschinenfabrik Aktiengesellschaft, Ingolstadt, Fed. Rep. of Germany

[21] Appl. No.: 255,231

[22] Filed: Oct. 11, 1988

[30] Foreign Application Priority Data

Oct. 13, 1987 [DE] Fed. Rep. of Germany ..... 3734568

[51] Int. Cl.[4] ..... D01H 13/00

[52] U.S. Cl. ..... 57/1 R; 57/268

[58] Field of Search ..... 57/1 R, 261, 262, 263, 57/264, 268, 271; 213/220, 221, 223

[56] References Cited

U.S. PATENT DOCUMENTS

| | | | |
|---|---|---|---|
| 3,011,204 | 12/1961 | Holtzclaw | 15/319 X |
| 3,360,914 | 1/1968 | Black et al. | 57/1 R X |
| 4,138,839 | 2/1979 | Stahlecker et al. | 57/263 X |
| 4,418,525 | 12/1983 | Raasch | 57/268 X |

*Primary Examiner*—Joseph J. Hail, III

*Attorney, Agent, or Firm*—Dority & Manning

[57] ABSTRACT

A spinning machine with unit to service spinning and winding stations, which is capable of travelling alongside the spinning machine and contains control and drive elements in a housing. The housing is enclosed by covers and is equipped with an anti-collision device taking effect in a direction opposite to the direction of travel. The anti-collision device of each direction of travel comprises two elements, of which the first element is attached to the lateral cover of the housing so as to be capable of pivoting. The first element is made to act as an actuating mechanism of the second element which acts upon the control elements.

11 Claims, 3 Drawing Sheets

SPINNING MACHINE WITH A DEVICE TO SERVICE SPINNING AND WINDING STATIONS

BACKGROUND OF THE INVENTION

The instant invention relates to a spinning machine with a device for servicing spinning and winding stations, which is capable of travelling alongside the spinning machine and contains control and drive elements in a housing which is closed by a cover and is equipped with an anti-collision device, acting in a direction opposite to the direction of travel of the device.

Spinning machines with devices of the above-mentioned type are known and are used often.

These devices, hereinafter also called servicing units, have parallel surfaces which serve as impact safeties. The anti-collision device has the task to stop the device's travel immediately when contact is made with an obstacle on the travel path of the device. To detect obstacles on the floor, the anti-collision device is mounted near the bottom of the housing. A small impact surface is provided for inspection tasks inside the housing, since it facilitates access to the control and drive elements. However, this entails the risk that operating personnel which might lean forward in the direction of the spinning machine, for example, may be caught by the device near the shoulder and head, without the activation of the anti-collision device taking place.

Large impact surfaces, which are also known, render access for inspection tasks more difficult. If the anti-collision device is disassembled for inspection, no safety is available, and the danger of injury to personnel is increased.

Known servicing units have been provided with covers which are screwed to the housing by a great number of sheet-metal parts. This means greater efforts and expense when the covers must be removed for inspection tasks and must then be screwed back on. For this reason no cover is provided in the area which must be accessible most frequently, so that the danger of injury to operating personnel and soiling of the control and drive elements is increased.

SUMMARY OF THE INVENTION

It is the object of the instant invention to provide effective impact security during maintenance work performed on the spinning and winding station and during inspection of the device, whereby easy accessibility to the control and drive elements in the housing for the inspection of the device is ensured.

This object is attained in that the impact security in each direction of travel consists of two elements, of which the first element is rotatably connected to the lateral cover and acts as an actuating means for the second element which acts upon the control elements.

This design makes it possible for an element of the anti-collision device to be removed from the housing simultaneously with the removal of the lateral cover and for easy accessibility to the control and drive elements. The element removed from the housing, serves in its mounted state as an actuating means for the second element which acts directly upon the control elements and, thus embodies the actual anti-collision device. The second element retains it function even without the first element, but the surface on which it can be activated is smaller than in the arrangement where both elements interact.

In a further embodiment of the invention, the lateral cover of the housing is pivotally mounted in pivot bearings on the side furthest from the spinning machine. The lateral cover of the housing can, thereby, be opened easily. When brief inspections are to be carried out, the cover remains suspended in the pivot bearings. Being mounted on the side away from the spinning machine, the cover can be opened wide and affords good accessibility to the control and drive elements.

Due to the fact that two adjoining covers have a common pivot, the accessibility to the control and drive elements is facilitated.

The covers are arranged so that they overlap the pivot bearings. This makes it possible to protect the pivot axis from fiber fly and dust. Furthermore, this arrangement ensures that no parts on which people can get caught and be injured project out of the housing.

In a further embodiment of the invention, the covers can be unhinged so that the control and drive elements can be easily reached for extended inspections.

The covers are held in the locked position by means of quick-release locks on three locations of every cover. The quick-release locks makes it possible to open and to close any given cover with one movement of the hand. The quick-release locks at three locations, also ensures that each cover closes tightly against the frame of the device and cannot be partially opened by loads attached thereto, such as, for example, that applied by the first element of the anti-collision device.

A further embodiment of the invention provides for the first element of the anti-collision device to be installed in the upper part of the housing, and to extend downward over the height of the housing. This means that the anti-collision device takes effect at every point where the housing could come into contact with an obstacle that may be present in the travelling path of the device as long as the first element is able to act upon the second element. The second element of the anti-collision device can be actuated independently of the first element, so that the anti-collision device takes effect even without the first element.

The second element of the impact element is installed in the prolongation of the lower level of the housing. Easy accessibility to the control and drive elements facilitates inspection tasks with opened or unhinged covers, where the anti-collision device is, nevertheless, still present. The anti-collision device is located at the lowest point of the device. This ensures that low, as well as tall, obstacles which are in the way of the servicing device can be detected by the anti-collision device and activate it. This is possible because the obstacles are often on the floor and thus touch the lower edge of the device, whatever their height may be.

The first element of the anti-collision device is connected magnetically to the second element. This has the advantage that the elements can be easily separated from each other and re-joined. Furthermore, the elements are connected to each other with sufficient strength so that they are not separated from each other as a result of the inertia when the device is accelerated.

The housing consists of housing parts which are connected to each other in a hinged manner. This decreases the depth of the housing and facilitates, in turn, inspection tasks. The electronic control elements are, preferably, installed in one of the pivotally mounted housing parts, where a well arranged installation of the control and drive elements is possible in the housing. It is also possible to produce housing parts which fit into each other, with their pivot on the side of the spinning machine or on the side away from the spinning machine.

The need for an anti-collision device for a travelling servicing device, during automatic travel, as well as during manual inspection, has been met through the instant invention in an inspection-friendly manner, i.e. with easy accessibility to the control and drive elements.

BRIEF DESCRIPTION OF THE DRAWINGS

Embodiments of the invention are explained in greater detail below through the drawings in which.

DETAILED DESCRIPTION OF THE DRAWINGS

Figure 1:
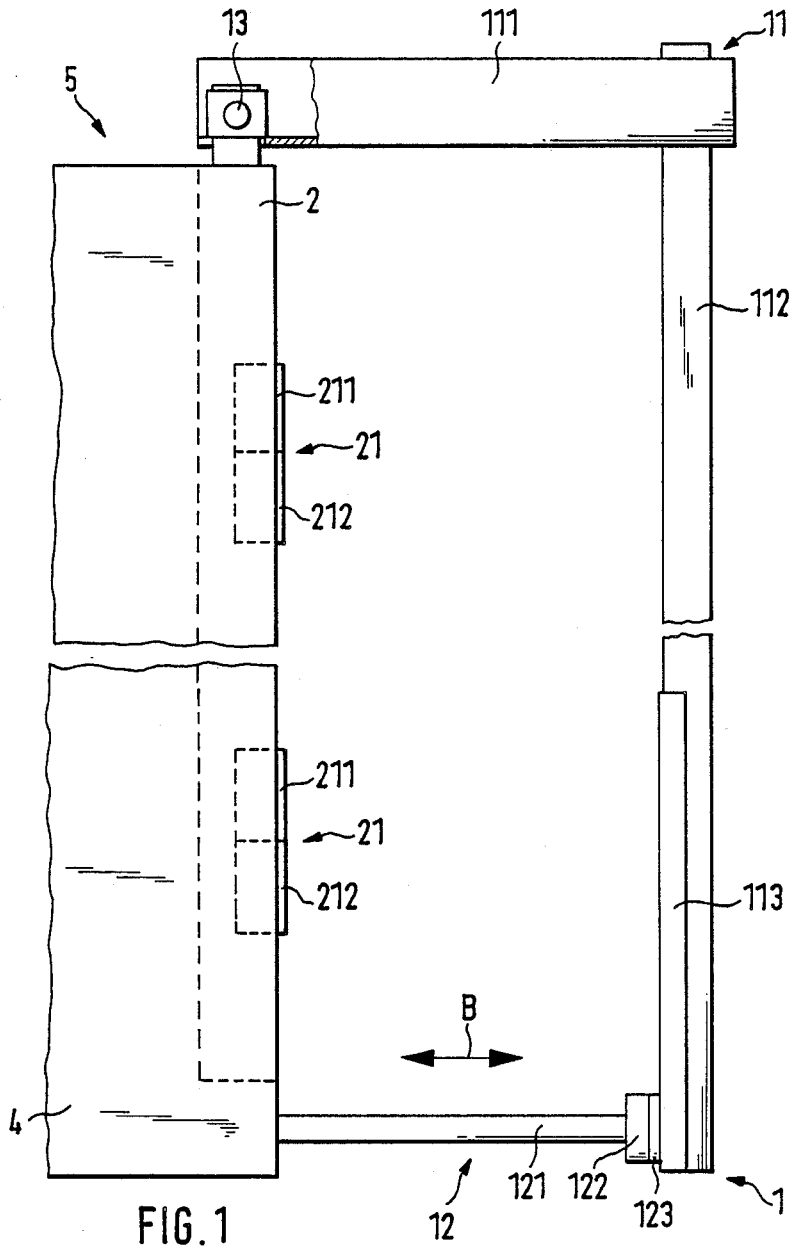
FIG. 1 shows a side view of the anti-collision device of the invention.

FIG. 1 shows a side view of an anti-collision device 1. Two elements 11 and 12, which interact, can be seen. The first element 11 is connected through a pivot bearing 13 to a lateral cover 2. The element 11 consists of a support plate 111, rods 112 and a reinforcement 113. The pivot bearing 13 and the rods 112 are attached to the support plate 111. The reinforcement 113 has contact with a magnet 123 of the second element 12. This element 12 comprises a connecting rod 121 acting upon the control element, as well as of an impact surface 122 to transmit the impact of the obstacle to the connecting rod 121.

The entire element 11 can be pivoted around pivot bearing 13 in such manner that it acts upon the second element 12 of the anti-collision device 1 at the end with the largest lever arm. The rotational movement of the element 11 is converted into a translational movement of element 12. Element 12 acts upon the control elements (not seen) which are in a housing 4 and interrupts the travelling movement of the servicing unit 5 when the element 12 has moved a predetermined distance in housing 4.

The element 11 is connected via a magnet 123 to the element 12. This magnet 123 makes it possible, on the one hand, to change the rotational movement into the translational movement since the elements 11 and 12 can slide against each other, and on the other hand, the element 11 is prevented from swinging in the fashion of a pendulum due to inertia, and from moving in an uncontrolled manner when the speed of the servicing unit 5 is greatly accelerated.

Cover 2 is supported in housing 4 by the pivot joints 21. Here at least two articulation pins 211 are attached to the lateral cover 2. The articulation pins 212 are attached to the housing 4 and are set back sufficiently so that the pivots are located within the outer contour of the servicing unit 5. The front cover 3 is supported in the same manner as the lateral cover 2. Both covers 2 and 3 can be lifted out of the pivot joints 21 by lifting the covers 2, 3 and can be removed from the housing.

The double arrow B shows the directions in which the element 12 can move. If the movement in the direction of the housing 4 results from an external influence, a signal is released which causes the travel of the servicing unit 5 to be interrupted. The element 12 then moves automatically back into its original position and is ready to be released again.

Figure 2:
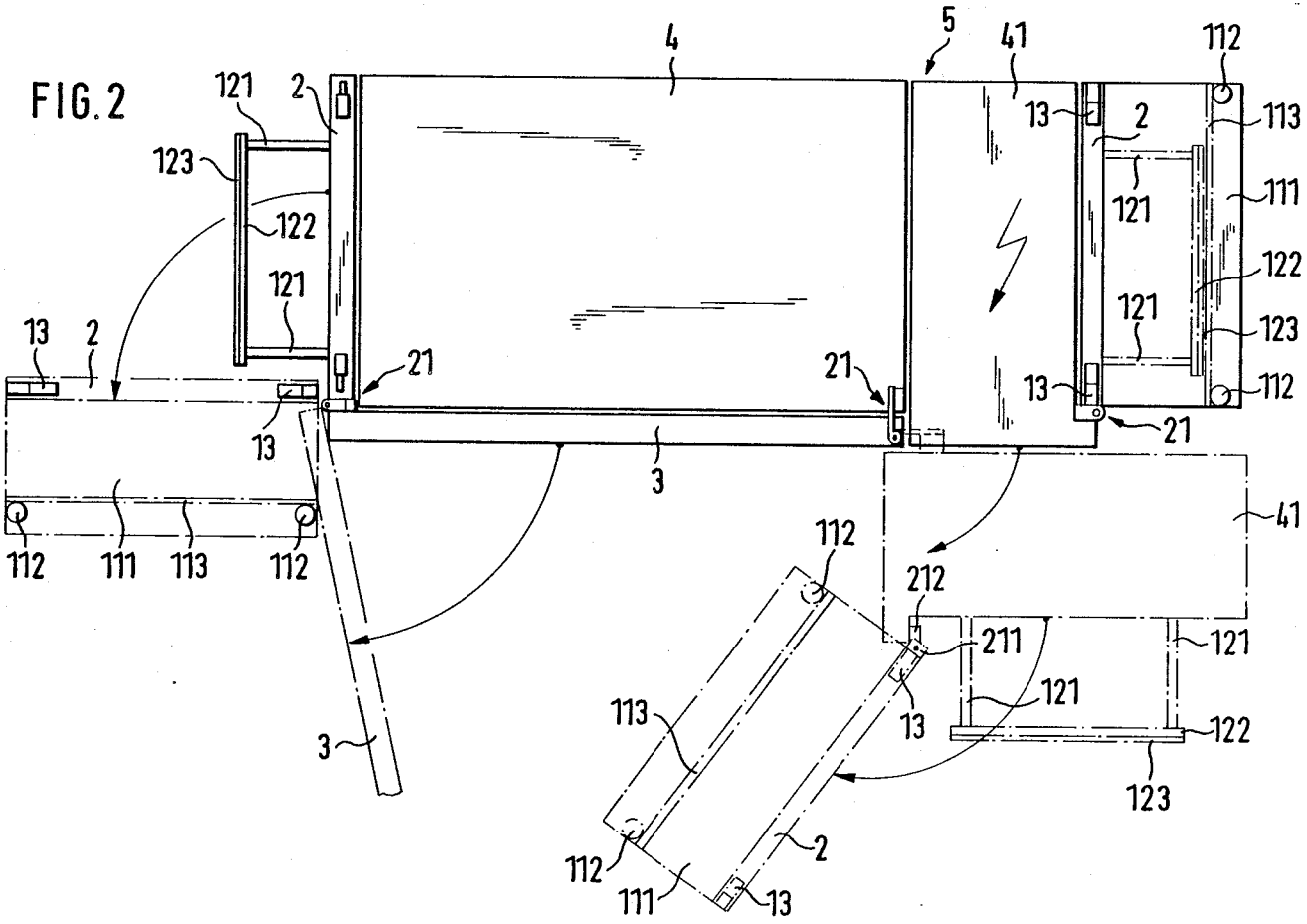
FIG. 2 shows a top view of the device shown in FIG. 1, with a view of the hinged cover.

FIG. 2 shows a top view of the servicing unit 5. For the sake of clarity the left anti-collision device 1 was not drawn in full lines. The covers 2 and 3, as well as a rotatable housing part 41 of the housing 4 are shown in an open and in a closed state. Each of the rotatably mounted elements 2, 3 and 41 can be pivoted by approximately 90° in order to afford easy accessibility to the control and drive elements behind it.

The opened covers 2, 3 and part 41 make it easy to reach into the housing 4 or into the rotatable housing part 41. At the same time the anti-collision device 1 which extends as far as into the housing 4 or into part 41 with its element 12 remaining fully functional. When the covers 2 are opened element 11 becomes non-functional. The element 12, however, remains fully in force, so that a safety against impact is still ensured.

The housing part 41 serves as a switch box in which the electronic control elements are installed. This switch box remains operational even in the opened state. The pivoting of part 41 is effected in a similar manner as for the lateral and front covers 2 and 3. Here too, the pivot joint 21 remains behind the outer contour of the servicing device 5, so that there are no projecting edges and so that the pivot joint 21 is protected from dirt.

The rotatable housing part 41 also facilitates inspection tasks on the servicing device 5, since the electronic control elements in part 41 as well as the control and drive elements in housing 4 become easily accessible.

The front cover 3 is made in one part. It protects the control and drive elements located in housing 4 from unauthorized access and from dirt. Furthermore, it covers the articulations 21 of a lateral cover 2, and of the housing par 41.

Figure 3:
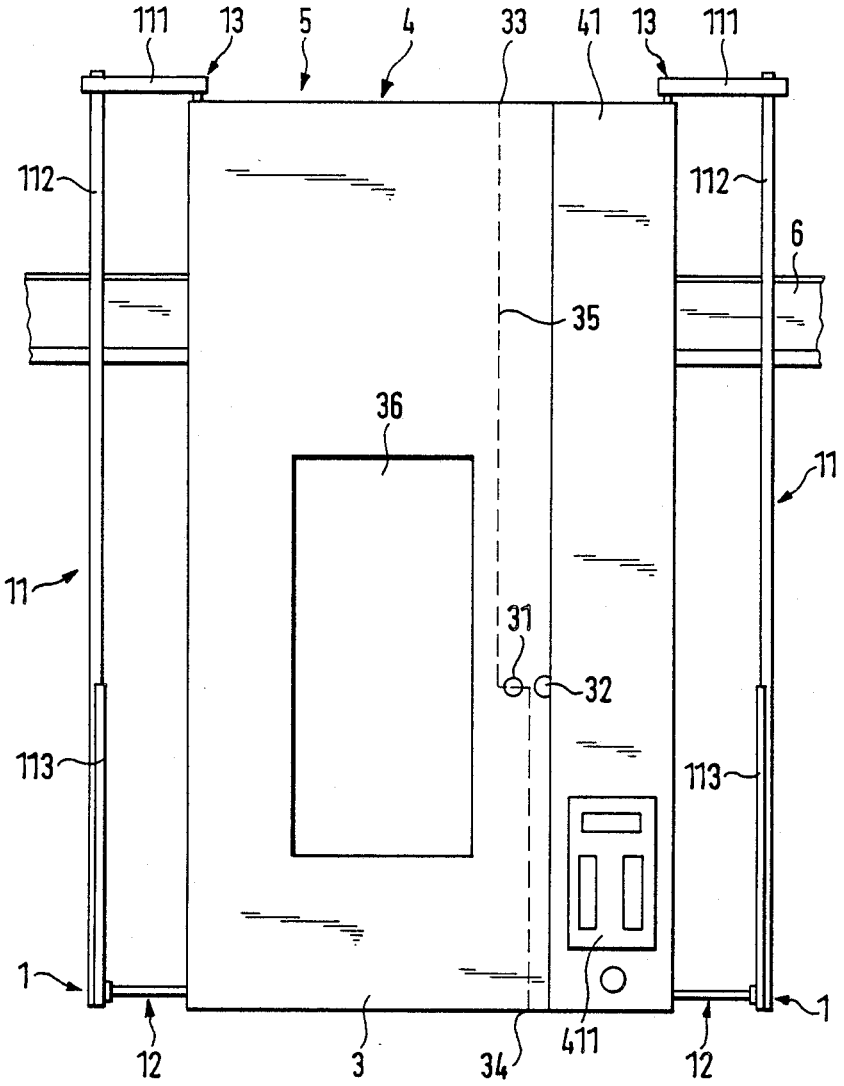
FIG. 3 is a front view of the device shown in FIG. 1.

A window 36 in the front cover 33 is shown in FIG. 3. It makes it possible to see the control and drive elements in housing 4. This facilitates the detection of defects since the processes can be observed in housing 4.

The front cover 3 is locked in the same manner as for the lateral covers 2 and the pivoting part 41, through a quick-release lock 31, but is only shown for the front cover 3. The quick-release lock 31 locks parts 2, 3 and 41 and acts directly on locking point 32 as well as (through locking rods 35) on the upper and lower locking points 33 and 34. The quick-release lock can be activated in a known manner by means of a key or a latch. The locking points 33 and 34 ensure tight closing of the covers 3 and 3 against housing 4, so that the control and drive elements are protected from dirt.

The pivot bearing 13 of the anti-collision device 1 is installed over the housing 4 so that pivotal movement of the lateral covers 2 may be possible over a large area without having element 11 knock into housing 4 or housing part 41.

Display and input elements 411 which are in direct connection to the electronic control elements are installed on the housing part 41. These display and input elements 411 are able to function also when the housing part 41 is an opened state, and this, in turn, facilitates inspection, as the display and input elements 411 can be pivoted into the field of vision of the operator.

The entire servicing unit 5 travels along a rail 6. However, only housing 4 is moved on the rail 6. Therefore it is possible to pivot the housing part 41, whatever the position of the servicing unit 5 may be.

In the illustrated embodiment of the second element 12 of the anti-collision device 1 swivels to the side together with housing part 41. However, it is also possible for the element 12 to be mounted directly in the housing 4 and to be thus held in its position, even when the housing part 41 is swivelled.

The first element 11 of the anti-collision device 1 extends over the entire height of the housing 4. This causes every obstacle in the path of the servicing unit 5 to be detected and to be signalled to the control elements. At the bottom of element 11, where a collision would be most likely and would occur most frequently, a reinforcement 113 reinforces element 11. In addition to reinforcing the element 11 it serves to prevent small obstacles from passing through the rods 112 and to collide with the servicing device 5.

What is claimed is:

1. In a yarn spinning machine having a plurality of yarn spinning and winding stations and a servicing unit which travels alongside said spinning machine for servicing said stations, said servicing unit having control and drive elements disposed thereon for controlling the travel of said servicing unit, and an anti-collision device comprising:

(a) A first collision element pivotally supported on said servicing unit in a position to contact any obstruction in the path of said servicing unit during its travel alongside said spinning machine;

(b) a second collision element supported for reciprocal movement on said servicing unit and disposed between a portion of said first element and said servicing unit in a position to contact any obstruction in the path of said servicing unit and having a portion in contact with said first element; and (c) means connected to said second element to actuate said control and drive elements when said first or second collision elements contact an obstruction in the path of said servicing unit to stop the travel of said servicing unit.

2. In a spinning machine as set forth in claim 1, wherein said servicing unit has a lateral cover which is mounted in pivot joints in such a manner as to be capable of pivoting on the side of said unit away from said spinning machine.

3. In a spinning machine as set forth in claim 2, wherein the side of said servicing unit away from said spinning machine is provided with two adjoining covers supported by a common pivot.

4. In a spinning machine as set forth in claim 3, wherein said covers overlap said common pivot.

5. In a spinning machine as set forth in claim 4, wherein said covers are held in a locked position by means of a quick release lock.

6. In a spinning machine as set forth in claim 1, wherein said first collision element is pivotally supported on the upper portion of said servicing unit and extends downwardly over the entire height of said servicing unit.

7. In a spinning machine as set forth in claim 1, wherein said second collision element ca be activated independently of said first collision element.

8. In a spinning machine as set forth n claim 1, wherein said second collision element is installed in an extension of the lower portion of said servicing unit.

9. In a spinning machine as set forth in claim 1, wherein said first collision element is magnetically linked to said second collision element.

10. In a spinning machine as set forth in claim 1, wherein said servicing unit comprises a housing having a plurality of parts which are connected to each other by hinges.

11. In a spinning machine as set forth in claim 10, wherein said control and drive elements comprise electronic means installed in one of said housing parts.

* * * * *